US005399376A

United States Patent [19]

Flinchum et al.

[11] Patent Number: 5,399,376

[45] Date of Patent: Mar. 21, 1995

[54] MENISCUS COATING STEEL STRIP

[75] Inventors: Charles Flinchum, Hamilton; Timothy R. Roberts, Middletown; Forrester Caudill, Middletown; Larry E. Parrella, Middletown, all of Ohio; David L. Kleimeyer; Gerald L. Barney, both of Ashland, Ky.

[73] Assignee: Armco Steel Company, L.P., Middletown, Ohio

[21] Appl. No.: 40,734

[22] Filed: Mar. 31, 1993

Related U.S. Application Data

[63] Continuation of Ser. No. 803,278, Dec. 4, 1991, abandoned.

[51] Int. Cl.[6] ..... B05D 1/26

[52] U.S. Cl. ..... 427/209; 427/321; 427/329; 427/349; 427/406; 427/43 B; 427/434.3; 427/434.5

[58] Field of Search ..... 427/434.3, 433, 209, 427/321, 329, 349, 406, 434.5; 118/405, 419

[56] References Cited

U.S. PATENT DOCUMENTS

| | | | |
|---|---|---|---|
| 2,914,419 | 6/1959 | Oganoski . | |
| 2,914,423 | 11/1959 | Knapp . | |
| 3,272,176 | 4/1966 | Saydlowski . | |
| 3,605,863 | 2/1967 | King . | |
| 4,152,471 | 5/1979 | Schnedler et al. | 427/310 |
| 4,285,995 | 9/1981 | Gomersall | 427/406 |
| 4,529,628 | 7/1985 | Haour et al. | 427/319 |
| 4,557,953 | 12/1985 | Boston et al. | 427/432 |
| 4,973,500 | 11/1990 | Ishii et al. | 427/436 |
| 5,141,781 | 8/1992 | Suzuki et al. | 427/406 |

FOREIGN PATENT DOCUMENTS

| | | | |
|---|---|---|---|
| 61-12026 | 4/1986 | Japan | 427/209 |
| 207556 | 9/1986 | Japan . | |
| 235550 | 10/1986 | Japan . | |
| 2085327 | 4/1982 | United Kingdom . | |

*Primary Examiner*—Shrive P. Beck
*Assistant Examiner*—Katherine A. Bareford
*Attorney, Agent, or Firm*—R. J. Bunyard; L. A. Fillnow; R. H. Johnson

[57] ABSTRACT

Method and apparatus for meniscus coating one or two sides of steel strip with a metal or metal alloy. The apparatus includes a horizontally disposed coating tray for containing molten coating metal, means for maintaining the temperature of the coating metal above the melting point of the coating metal, means for moving steel strip transversely past a departure lip positioned on one side of the coating tray and means for maintaining the level of the coating metal in the coating tray relative to the upper elevation of the departure lip so that an uninterrupted flow of the coating metal can be delivered over the departure lip to a surface of the strip. The coating tray may be rotatably mounted for adjusting the level of molten metal in the coating tray. The coating tray also may include means for lateral displacement for positioning the departure lip a predetermined distance away from the strip. The terminal end of the departure lip preferably includes a planar upper surface having an acute angle of at least 15° relative to the horizontal plane of the coating tray. Non-oxidizing gas may be passed through a jet nozzle to control the coating thickness on the strip.

43 Claims, 9 Drawing Sheets

| | Coating Weight (g/m2) | %Fe | 60° Reverse Bend Tape Test | Rating |
|---|---|---|---|---|
| Invention (Meniscus) | 60 | 8.9 | | 0.5 |
| Conventional (Immersion + Post Heat) | 61 | 9.7 | | 1.0 |

FIG. 13

MENISCUS COATING STEEL STRIP

CROSS-REFERENCE TO RELATED APPLICATION

This is a continuation of U.S. application Ser. No. 07/803,278, filed on Dec. 4, 1991, now abandoned.

BACKGROUND OF THE INVENTION

This invention relates to a method and an apparatus for meniscus coating at least one surface of steel strip with molten metal. More particularly, the invention relates to moving at least one of the strip surfaces transversely past a departure lip of a horizontally disposed coating tray containing the molten metal. The strip surface is wetted by meniscus contact with the molten metal flowing over the departure lip and onto the passing strip.

It has been known for many years the corrosion resistance of steel strip could be enhanced by immersion into a bath of molten metal. Product quality in an immersion process is inconsistent because of changes in the surface condition of the pot rolls in the bath. This surface condition change is caused by erosion to the roll surface and build up of iron intermetallic particles on the roll surface. This pot roll surface condition may mark the strip surface. The strip surface also can be scratched if the strip drifts across the pot roll surface. A further product quality problem associated with immersion coating is nonuniform coating thickness because of pass line instability and poor strip shape.

Another problem associated with immersion coating is the requirement for a large molten metal reservoir. The large pot size requires considerable capital expense during initial installation, requires significant maintenance expense and requires considerable operating expense for the thermal input necessary to maintain the bath temperature.

A further problem associated with immersion coating relates to scheduling a coating line, particularly in the steel industry. Scheduling a coating line according to strip thickness and width is important for producing high quality material. Thin strip is easily damaged and preferably coated using fresh pot rolls. Because pot roll build up frequently occurs at those portions of the pot roll corresponding to strip edges, wider strip normally is not scheduled to follow narrower strip. This unpredictable service life of coating pot equipment results in unscheduled coating line stoppages.

Scheduled production runs normally are for a long duration with steel strip receiving the same coating type with only gradual decreasing width changes being permitted. This may require maintaining an excess amount of steel inventory for extended periods of time because strip requiring a coating metal type or a width not corresponding to the current production schedule can not be scheduled. This not only increases costs for the manufacturer but also for the customer.

More recently, techniques have been developed to coat one or both sides of steel strip with molten metals using a meniscus. U.S. Pat. No. 4,557,953 discloses horizontal meniscus coating one side of steel strip. A cleaned strip is passed from a snout chamber to a large coating pot containing molten metal. Deflection rolls are used to pass the strip sufficiently close to the molten metal surface so that molten metal wets the lower surface of the strip. Molten metal is withdrawn from the pot onto the surface of the strip. U.S. Pat. No. 4,529,628 discloses vertical meniscus coating one side of a steel strip. A coating device is provided to include a melting furnace having a lateral distribution conduit whose outlet communicates with an externally open release aperture serving to distribute molten metal over the entire width of a vertically traveling strip. Pressurized molten metal is forced through the release aperture and flows downwardly by gravity into a gap formed between the aperture and the strip. Japanese patent application 61-207556 also discloses vertical meniscus coating one side of steel strip. A tank containing molten metal includes a plating nozzle for positioning close to a surface of a vertically traveling strip. The level of the molten metal is maintained in the tank at a level above the elevation of the nozzle using a head pressure of 10–30 mm so that the molten metal can be withdrawn from the nozzle onto the strip surface.

U.S. Pat. No. 2,914,423 discloses coating a metal strand such as steel wire or strip. A molten metal reservoir includes a conically shaped extension with the strand being passed vertically up through an orifice in the center of the extension.

Nevertheless, there remains a need for a high speed process for coating one or both surfaces of steel strip with molten metal that can eliminate product quality problems such as nonuniform coating thickness and poor strip shape. There also remains a need for a high speed process providing uninterrupted coating line operation when it becomes necessary to change the molten metal type, strip width, the number of surfaces of the strip to be coated or when coating both surfaces of the strip with different types of molten metal. There also is a need for a high speed coating process where the coating bath does not include iron intermetallics. There is also a need for a high speed coating process where the strip surface is not damaged by a pot roll. Furthermore, there remains a need for a high speed process that does not require pressurized delivery of molten metal onto the strip surface or a large reservoir for the molten metal.

BRIEF SUMMARY OF THE INVENTION

The invention relates to a method and an apparatus for meniscus coating at least one surface of steel strip with molten metal. The apparatus includes a horizontally disposed coating tray for containing molten coating metal, means for maintaining the temperature of the coating metal above the melting point of the coating metal, means for moving steel strip transversely past a departure lip positioned on one side of the coating tray, means for maintaining the level of the coating metal in the coating tray relative to the upper elevation of the departure lip so that an uninterrupted flow of the coating metal can be delivered over the departure lip to a surface of the strip.

Preferred embodiments of the apparatus include a furnace for premelting make-up coating metal, means for rotating the coating tray to establish meniscus contact at the start of a coating sequence, means for laterally shifting the coating tray to maintain proper spacing between the departure lip and the strip surface and means for controlling the thickness of the coating layer on the strip. The terminal end of the departure lip may be profiled with the upper surface being inclined at an acute angle of at least 15° relative to the horizontal plane of the coating tray.

A principal object of the invention is to provide substantially uninterrupted strip travel when coating metal type or strip width changes.

Another object includes forming duplex coated steel strip.

A further object includes reducing the amount of time and thermal energy required to convert a zinc coating on steel strip to a zinc iron alloy coating.

A further object of the invention is to eliminate the requirement for a large reservoir for containing molten coating metal.

A feature of the invention includes meniscus coating at least one surface of steel strip with metal by providing a horizontally disposed coating tray having a departure lip, the coating tray containing molten metal, providing a clean steel strip, moving the strip transversely past the departure lip, wetting a surface of the strip with the molten metal by meniscus contact so that the molten metal flows continuously from the departure lip onto the strip surface and maintaining the molten metal in the coating tray at a level relative to the upper elevation of the departure lip so that an uninterrupted flow of the molten metal is delivered to the surface of the strip.

Another feature of the invention includes meniscus coating at least one surface of steel strip with metal by providing a horizontally disposed coating tray having a departure lip, the coating tray containing molten metal, preparing a steel strip by heating in a reducing atmosphere, cooling the heated strip to a temperature near the melting point of the molten metal, moving the strip transversely past the departure lip, wetting a surface of the strip with the molten metal by meniscus contact so that the molten metal flows continuously from the departure lip onto the strip surface and maintaining the molten metal in the coating tray at a level relative to the upper elevation of the departure lip so that an uninterrupted flow of the molten metal is delivered to the surface of the strip.

Another feature of the invention includes meniscus coating at least one surface of steel strip with zinc by providing a horizontally disposed coating tray having a departure lip, the coating tray containing molten zinc, preparing a steel strip by heating in a reducing atmosphere, cooling the heated strip to a temperature less than 500° C., moving the strip transversely past the departure lip, wetting the strip surface with the molten zinc by meniscus contact so that the molten zinc flows continuously from the departure lip onto the strip surface and maintaining the molten zinc in the coating tray at a level relative to the upper elevation of the departure lip so that an uninterrupted flow of the molten zinc is delivered to the surface of the strip.

Another feature of the invention includes meniscus coating at least one surface of steel strip with zinc by providing a horizontally disposed coating tray having a departure lip, the coating tray containing molten zinc, preparing a steel strip by heating in a reducing atmosphere, cooling the heated strip to a temperature less than 550° C., moving the strip transversely past the departure lip, wetting the strip surface with the molten zinc by meniscus contact so that the molten zinc passes continuously from the departure lip, maintaining the molten zinc in the coating tray at a level relative to the upper elevation of the departure lip so that an uninterrupted flow of the molten zinc can be delivered to the strip surface and interdiffusing iron from the strip with the zinc coating, without using post heating, whereby the zinc coating is completely alloyed with iron and contains no or minimal gamma phase zinc.

Another feature of the invention includes meniscus coating at least one surface of steel strip with metal by providing a plurality of horizontally disposed coating trays each including a departure lip, the coating trays containing molten metal, providing a clean steel strip, moving the strip transversely past the departure lips, wetting a surface of the strip with the molten metal by meniscus contact so that the molten metal flows continuously from the departure lip onto the strip surface and maintaining the molten metal in the coating trays at a level relative to the upper elevation of the departure lips so that an uninterrupted flow of the molten metal is delivered to the strip surface.

Another feature of the invention is for two of the coating trays of the aforesaid feature to be positioned on opposite sides of the strip whereby a two side coated strip is produced.

Another feature of the invention is for each of the two coating trays of the aforesaid feature to contain a different molten metal whereby a two side duplex coated strip is produced.

Another feature of the invention is for the molten metal of the aforesaid feature being zinc whereby two sided galvanized strip is produced with the zinc coating on one of the sides being completely alloyed with iron diffused from the strip.

Another feature of the invention is for the molten zinc in one of the coating trays of the aforesaid feature being a first composition and the molten zinc in the other coating tray being a second composition.

Another feature of the invention is an apparatus for meniscus coating at least one surface of steel strip with metal including a horizontally disposed coating tray for containing coating metal including a departure lip, means for maintaining the temperature of the coating metal in the coating tray above the melting point of the coating metal, means for moving steel strip transversely past the departure lip, means for maintaining the level of the coating metal in the coating tray, the level being controlled by the maintenance means relative to the upper elevation of the departure lip so that an uninterrupted flow of the coating metal can be delivered over the departure lip to a surface of the strip and means for controlling the thickness of the coating metal on the strip.

Another feature of the invention of the aforesaid feature is for the apparatus to include a stabilizing roller positioned below the coating tray for guiding the strip past the departure lip.

Another feature of the invention of the aforesaid feature is for the coating tray to be displaceable.

Another feature of the invention of the aforesaid feature is for the departure lip to have an upper planar surface being at an acute angle relative to the horizontal plane of the coating tray.

Another feature of the invention of the aforesaid feature is for the coating tray to be enclosed within a sealed chamber for containing a non-oxidizing atmosphere.

Another feature of the invention of the aforesaid feature is for the apparatus to include a plurality of coating trays.

Another feature of the invention of the aforesaid feature is for at least two of the coating trays to be disposed on opposite sides of the strip.

Another feature of the invention is an apparatus for meniscus coating at least one surface of steel strip with metal including a horizontally disposed removable coating tray for containing coating metal including a departure lip mounted on a side of the coating tray, a furnace for melting make-up coating metal, means for delivering the molten make-up metal to the coating tray, means for moving steel strip transversely past the departure lip, a stabilizing roller for positioning below the departure lip for guiding the strip past the departure lip, means for maintaining the level of the coating metal in the coating tray, the level being controlled by the maintenance means relative to the upper elevation of the departure lip so that an uninterrupted flow of the coating metal over the departure lip can be delivered to a surface of the strip and a jet nozzle for being spaced from and transversely with the strip for controlling the thickness of the coating metal on the strip.

Another feature of the invention is an apparatus for meniscus coating both surfaces of steel strip with metal including a pair of horizontally disposed removable coating trays for containing coating metal each having a departure lip, each lip having an upper planar inclined surface, a furnace for premelting coating metal, means for delivering molten metal to the coating trays, means for moving steel strip transversely past the departure lips, a stabilizing roller positioned below the coating trays for guiding the strip past the departure lips, means for maintaining the level of the coating metal in the coating trays, the level being controlled by the maintenance means relative to the upper elevation of the departure lips so that an uninterrupted flow of the coating metal can be delivered over the departure lips to a surface of the strip and a pair of jet nozzles for being spaced from and transversely with the opposing surfaces of the strip for controlling the coating thickness.

Advantages of the invention include improved adherence of metallic coatings, improved powdering resistance of galvannealed coatings, improved control in and the ability to quickly change the composition of metallic coatings, minimizing iron within the molten metal bath by eliminating strip immersion, lower galvannealing temperature and elimination of post heating to produce galvannealed strip and the maintenance of a stable pass line resulting in more uniform coating thickness. The invention minimizes the capital cost of a molten metal reservoir, minimizes the operating maintenance expense of the reservoir and minimizes the operating expense for the thermal input necessary to maintain bath temperature in the reservoir. An additional cost advantage results from a reduction of steel strip inventory. Strip requiring a different coating metal type or requiring large changes in width can be scheduled sequentially without coating line stoppages to install new coating equipment or to make major coating equipment modifications.

The above and other objects, features and advantages of the invention will become apparent upon consideration of the detailed description and appended drawings.

BRIEF DESCRIPTION OF THE DRAWINGS

FIG. 13 is a pictorial representation comparing the powdering behavior of a galvannealed steel of the invention to a typical galvannealed steel made from an immersion process.

DETAILED DESCRIPTION OF THE PREFERRED EMBODIMENT

For the present invention, steel strip is prepared by removing oil, dirt, iron oxide and the like so that a strip surface is readily wetted by molten metal. Such preparation may be accomplished by chemical cleaning and then heating the strip to a temperature near the melting point of the coating metal. For steel strip to be deeply drawn, the strip preferably is given an in-line annealing treatment to clean the strip such as disclosed in U.S. Pat. No. 4,675,214, incorporated herein by reference, wherein the strip is heated to well above the melting point of the coating metal and then is cooled to near the melting point of the coating metal just prior to being coated with the molten metal. The heated strip is maintained in a protective atmosphere such as a reducing atmosphere of nitrogen-hydrogen or pure hydrogen. It will be understood the steel strip may include any ferrous base metal such as a low carbon steel or a chromium alloy steel. By molten metal will be understood to include commercially pure metal and metal alloys of zinc, aluminum, lead, tin, copper, and the like. For example, molten zinc will be understood to include commercially pure zinc or alloys of zinc unless otherwise indicated. It also will be understood the strip could be prepared and meniscus coated without heating by applying flux directly to the strip and then coating the flux coated strip with molten metal.

Figures 1, 2:
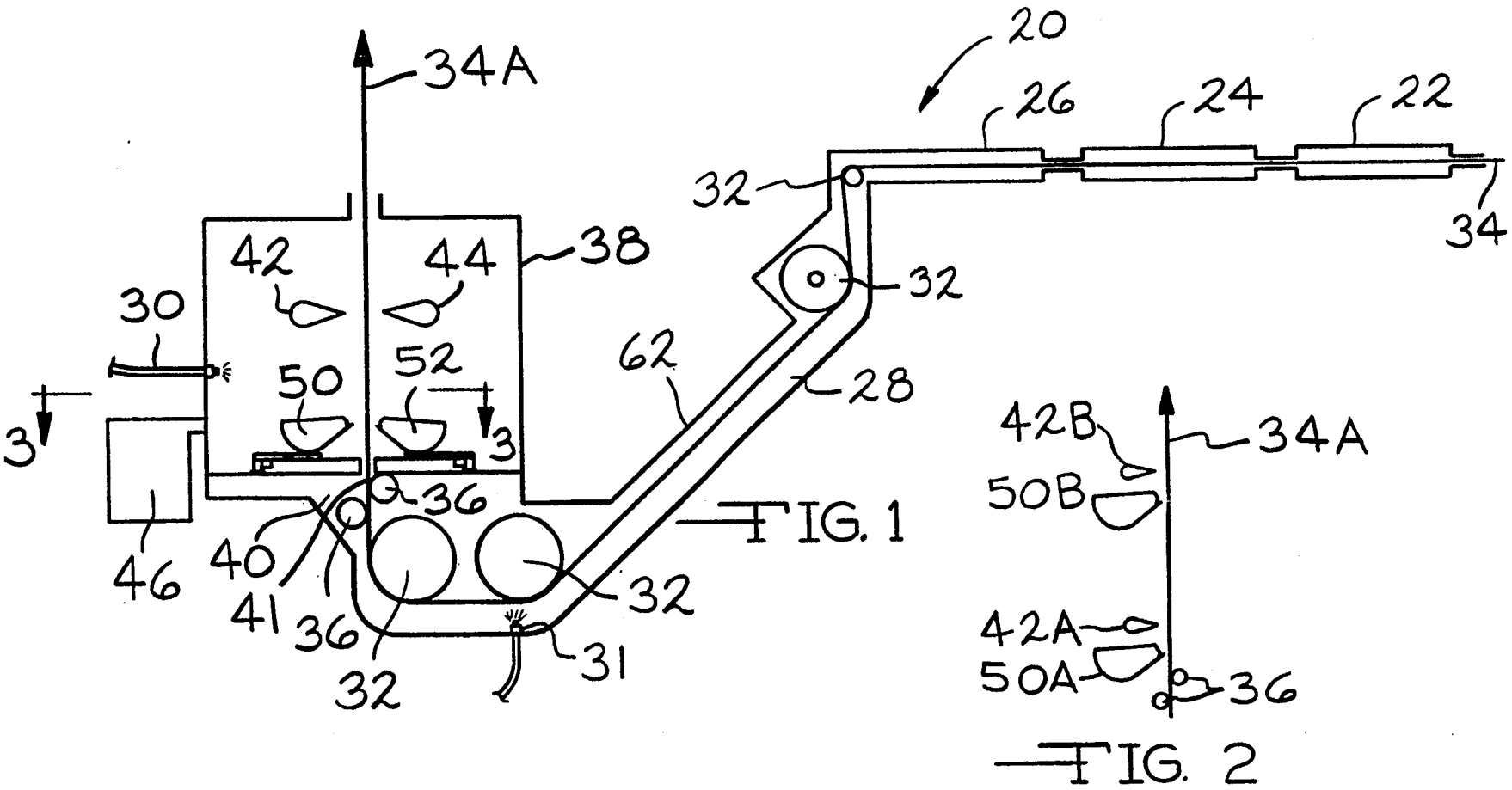
FIG. 1 is a diagrammatic view of a coating line of the invention for continuously meniscus coating at least one side of steel strip with molten metal.
FIG. 2 is a diagrammatic elevation view of a different embodiment of the coating trays of FIG. 1.
Figure 11A:
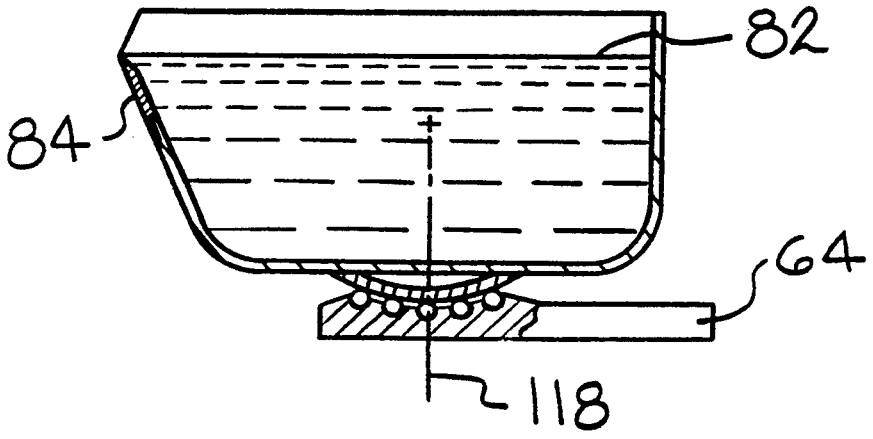
FIGS. 11A, 11B and 11C illustrate rotation of a coating tray.
Figure 11B:
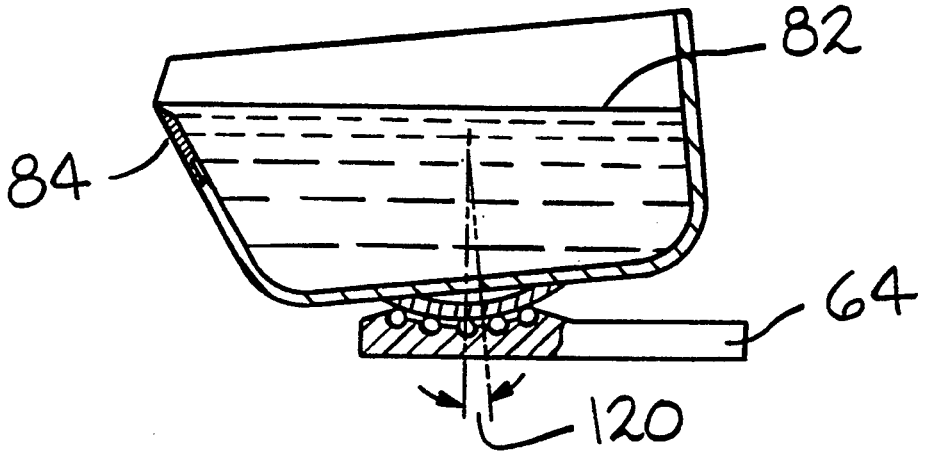

FIG. 1 illustrates use of the invention in a high speed coating line 20 including means (not shown) for moving a steel strip through the coating line and in-line strip preparation sections. Strip preparation may include cleaning and heating sections such as a Selas furnace, a Sendzimir furnace or modification thereof. FIG. 1 illustrates Selas cleaning and heating sections including a direct fired preheat furnace section 22, a radiant heating furnace section 24, a cooling section 26 and a snout 28 for protecting a cleaned steel strip 34 being delivered to a meniscus coating assembly of the invention. The coating assembly may include gas inlets 30 and 31, rollers 32 for changing the direction of travel of cleaned strip 34, means for stabilizing the strip pass line such as a pair of stabilizing rollers 36 positioned on opposite sides of strip 34 and slightly offset from one another, a coating chamber 38 for containing a protective atmosphere that is non-oxidizing to molten metal contained in a pair of horizontally disposed coating trays 50 and 52 positioned on opposite sides of strip 34 and means for controlling the thickness of the molten metal on as-coated strip 34A such as jet finishing nozzles 42 and 44 positioned on opposite sides of as-coated strip 34A. It will be understood by horizontal is meant a coating tray is disposed in a generally horizontal manner. For example, the coating tray may be positioned adjacent to strip 34 while being rotated at an angle from the horizontal (FIG. 11B). A protective atmosphere non-oxidizing to cleaned steel strip 34 is used in furnace section 24, cooling section 26 and snout 28. Means 62 for separating the atmosphere in snout 28 from the atmosphere in the coating assembly may be provided. For example, when coating chromium alloy steel, e.g., stainless steel, with molten aluminum, it is desirable to use pure hydrogen as the protective gas in each of furnace section 24, cooling section 26 and snout 28. Sealing means 62 may be used to prevent mixing of the hydrogen gas in snout 28 with the non-oxidizing gas, e.g., nitrogen, in chamber 38. If chamber 38 is not used, sealing means 62 prevents mixing of the protective gas in snout 28 with a protective gas, e.g., nitrogen, maintained within the sealed portion 40 of the coating assembly below the coating trays. Sealing means 62 is well known (see U.S. Pat. No. 4,557,953) and may be constructed using sealing rolls and/or slotted plates using differential pressure to prevent passage of the atmospheres past the sealing rolls or through the plate openings.

In operation, steel strip 34 may be heated in furnace sections 22,24 to a temperature near the melting point of the coating metal and up to as high as about 985° C. Deep drawing grades of low carbon and chromium alloy steels require heating to well above the melting point of the coating metal for good formability. The strip then would be cooled in cooling section 26 to near the melting point of the coating metal prior to being coated. Means for controlling coating thickness on as-coated strip 34A is provided. A pressurized gas non-oxidizing to the molten metal, e.g., high purity nitrogen, is directed from nozzles 42,44 to control the amount of molten metal remaining on strip 34A. If using non-oxidizing gas during galvanizing, water vapor preferably is injected into sealed chamber 38 through gas inlet 30 and possibly gas inlet 31 to prevent zinc vapor formation. When non-oxidizing gas is not required, sealed chamber 38 would not be necessary and may be removed from the coating assembly. In this situation, it still may be necessary to add water vapor through gas inlet 31 into sealed portion 40 between coating trays 50,52 and sealing means 62 during galvanizing to prevent zinc vapor formation. Details for heating steel strip 34 and the non-oxidizing atmosphere needed in furnace section 24, cooling section 26, snout 28 and coating chamber 38 are disclosed in U.S. Pat. Nos. 4,557,952; 4,557,953 and 5,023,113; all incorporated herein by reference.

FIG. 2 illustrates another embodiment of the coating trays of the invention wherein a plurality of coating trays are positioned one above another. A second coating tray **50*b* for containing a second molten metal is positioned above a first coating tray 50*a* for containing a first molten metal. The second molten metal may be the same as the first molten metal or may be a different type molten metal. Jet finishing nozzles 42*a* and 42*b* are provided for controlling the thickness on strip 34A of the coating metal delivered from coating trays 50*a* and 50*b*** respectively. By positioning one coating tray above another, the coating layer on the strip from an upper tray may be superimposed over the coating layer from a lower tray.

Figure 3:
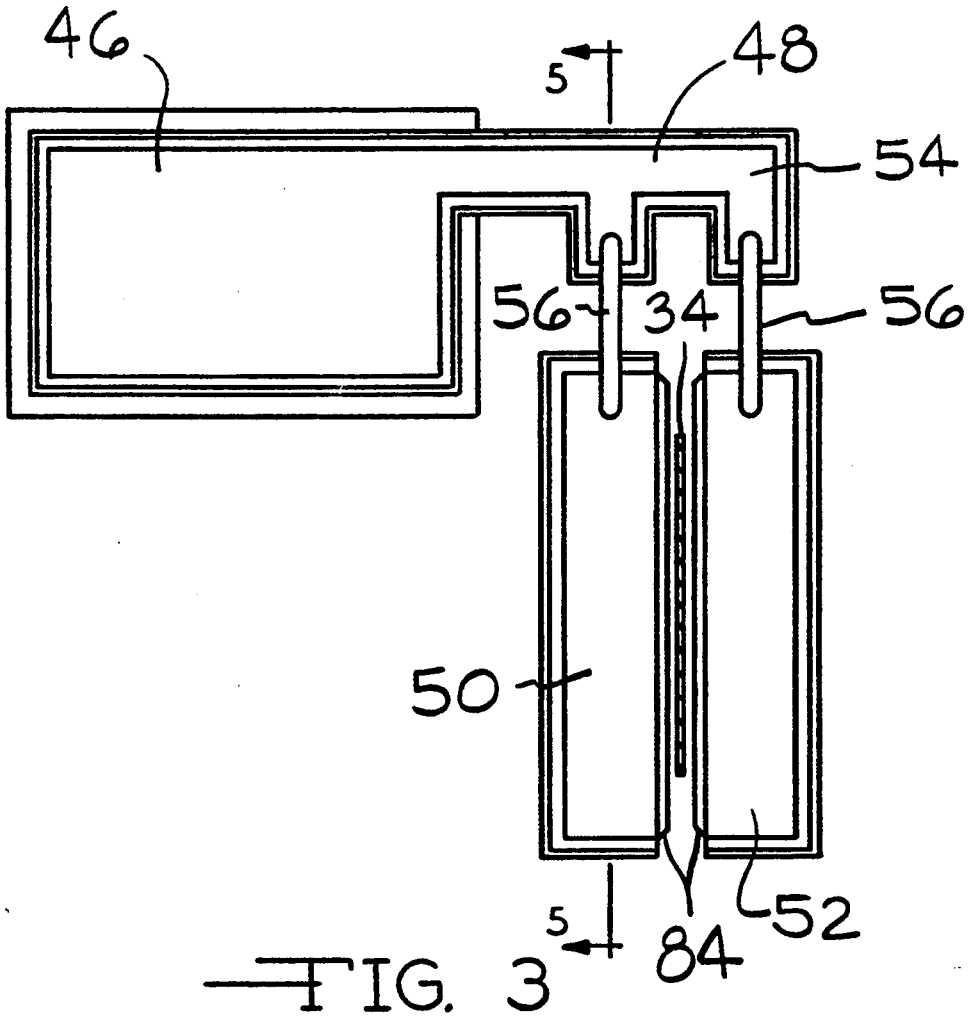
FIG. 3 is a plan view along line 3—3 of FIG. 1 illustrating a premelting furnace and means for delivering molten metal to the coating trays.

FIG. 3 is a plan view along line 3—3 of FIG. 1 illustrating the coating assembly including a refractory lined premelting induction furnace 46 and means 48 for delivering molten make-up metal to coating trays 50 and 52 positioned on opposite sides of strip 34 for meniscus coating one or both sides of the strip with molten metal. When using a premelting furnace, means 48 for delivering the molten make-up metal to a coating tray could be a pump or the melting furnace may be positioned at an elevation above the coating tray with the make-up metal being flowed to a coating tray by gravity. In the embodiment in FIG. 3, delivery means 48 includes a refractory lined runner 54 and a refractory lined siphon tube 56. Coating trays 50 and 52 are positioned on opposite sides adjacent to and transversely with the surfaces of strip 34 for coating both of the surfaces with molten metal. When coating only one surface of the strip with metal, the coating tray not being used may be withdrawn from the strip surface. Make-up coating metal also may be delivered as a solid directly into the metal bath in the coating tray such as by feeding ingots, pellets, wire and the like. Whether liquid or solid, make-up coating metal is delivered continuously or periodically to the coating tray to maintain the level of molten metal in the coating tray so that an uninterrupted flow of the molten metal is delivered to strip 34.

Coating trays 50 and 52 may be offset or separated by a short distance, e.g., less than 100 cm, from one another along the vertical path of travel of strip 34. As discussed in more detail below relating to duplex coatings, offset coating trays allow the strip to be cooled when applying coating metals having different melting temperatures. When the strip is coated with a duplex coating, offset coating trays also prevent undesirable molten metal cross flow around strip edges. Since it is difficult to maintain a seal between offset coating trays and the steel strip, offset coating trays should be surrounded by sealed chamber 38 to maintain a non-oxidizing atmosphere around cleaned strip 34. Finishing nozzles 42 and 44 are positioned on opposite sides of strip 34 and may be slightly offset from one another to prevent cross flow of the finishing gases.

Figure 4:
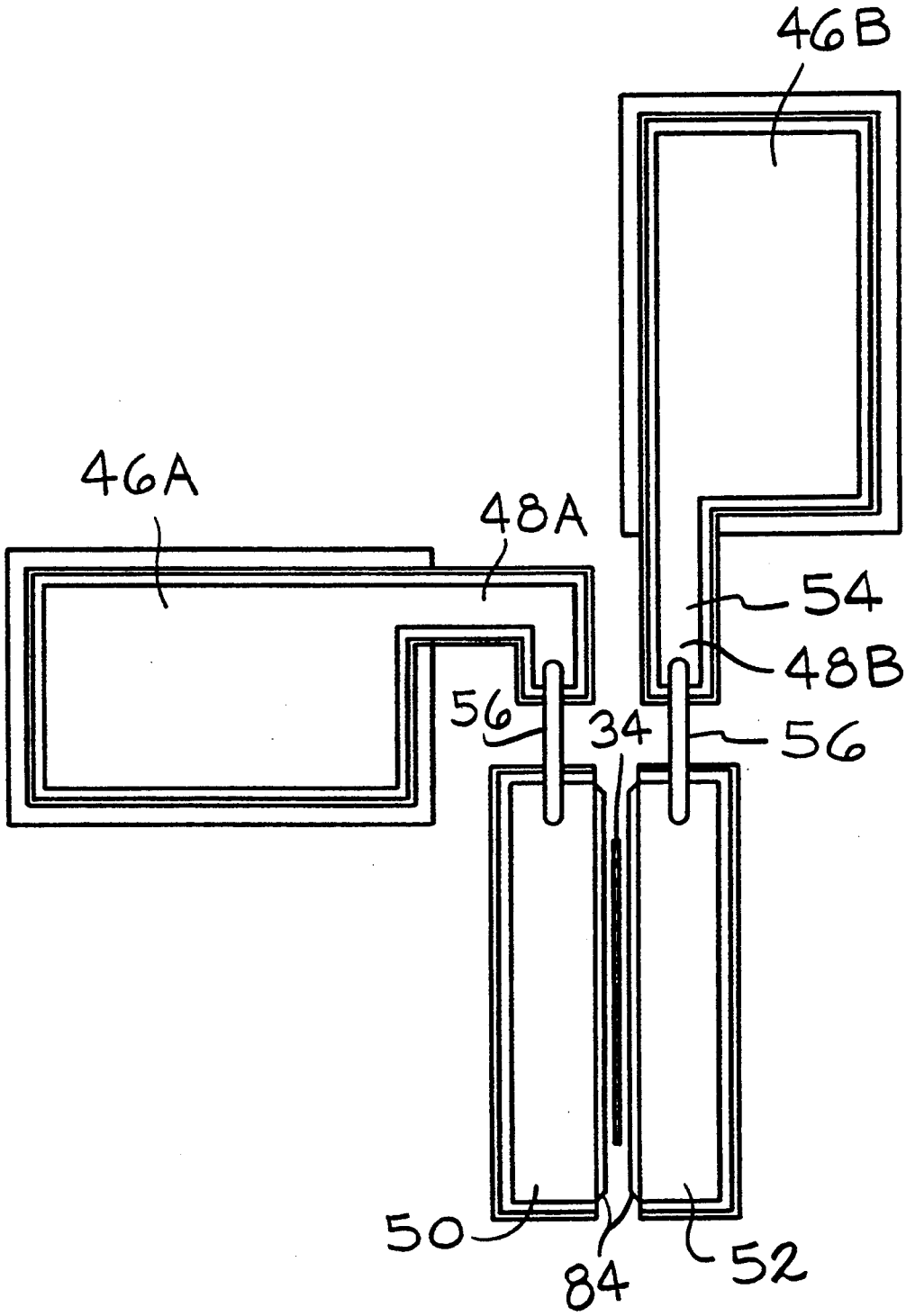
FIG. 4 is a view similar to that of FIG. 3 illustrating another embodiment of the invention.

FIG. 4 is a view similar to FIG. 3 illustrating another embodiment of the invention. In this embodiment, the coating assembly includes a premelting furnace 46A for melting a first type coating metal and a premelting furnace 46B for melting a different type coating metal for coating strip 34 with a duplex coating. Means 48B delivers molten make-up metal from furnace 46A to coating tray 50 and means 48B delivers molten make-up metal from furnace 46B to coating tray 52.

Figure 5:
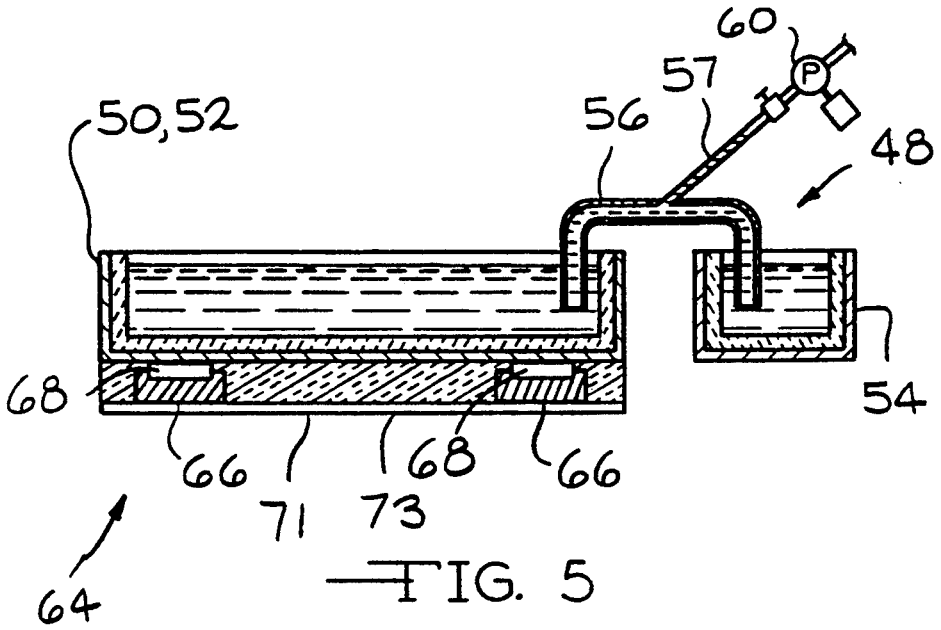
FIG. 5 is a section view along line 5—5 of FIG. 3 illustrating means for delivering molten metal to a coating tray.

FIG. 5 is a section view along line 5—5 of FIG. 3 illustrating details of additional features of molten metal delivery means 48 and means 64 for positioning coating trays 50,52. Delivery means 48 additionally may include a line 57 including a valve 60 connecting siphon tube 56 to a vacuum (not shown) for filling siphon tube 56 and means (not shown) for sensing the level of the metal bath in the coating tray. Make-up metal is flowed from runner 54 to coating trays 50,52 by momentarily closing off the delivery end of siphon tube 56 and applying a vacuum to line 57. The sensing means determines when the metal bath level drops below a predetermined elevation. The level of the bath in the coating tray may be sensed mechanically using a detector or determined empirically from the amount of molten metal removed from the coating tray and coated onto the steel strip. Positioning means 64 preferably provides for rotation of each coating tray relative to the adjacent planar surface of the steel strip and also provides for lateral movement toward and away from the planar strip surface as well. The positioning means also could include a carousel for positioning one of a plurality of coating trays adjacent to and transversely with a surface of the strip.

Figure 6:
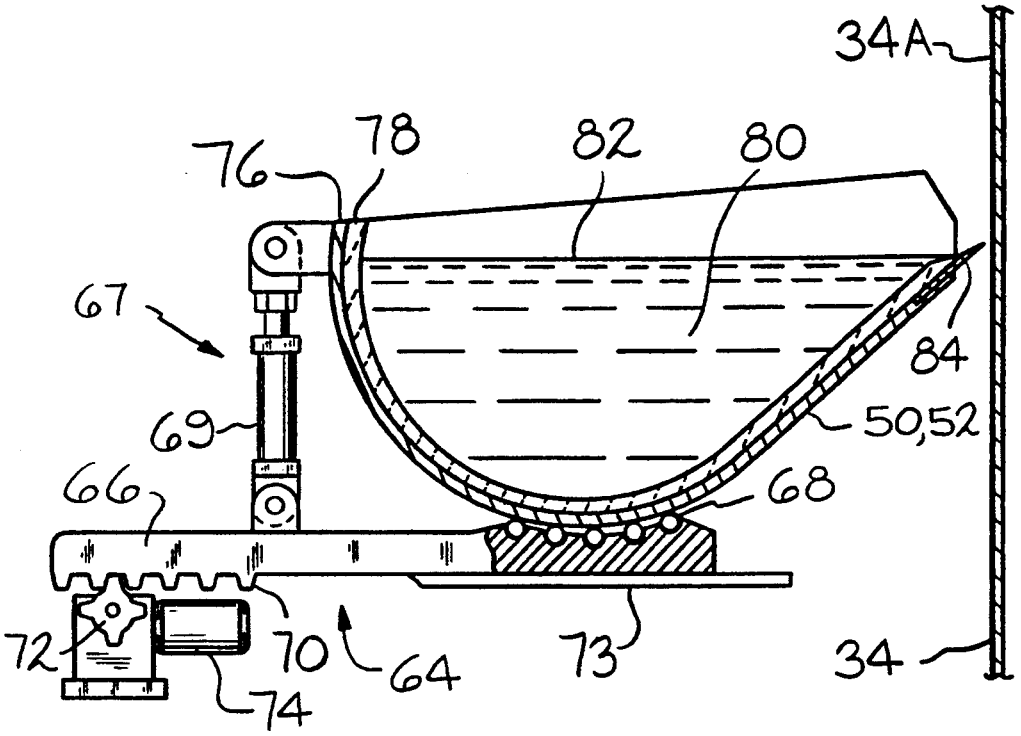
FIG. 6 is an elevation view, partially in section, of the coating tray in FIG. 5 illustrating means for positioning the coating tray.

FIG. 6 is an elevation view, partially in section, of the coating tray and positioning means 64 of FIG. 5 without meniscus contact between the molten metal and strip 34 moving upwardly in a generally vertical direction. Each coating tray 50,52 includes an outer steel liner 76, an inner refractory lining 78 such as plastic ceramic for containing a molten metal 80 having an upper surface 82 and an upwardly inclined departure lip 84 mounted on one side of each the coating trays. Departure lip 84 is positioned adjacent to and transversely with a planar strip surface to be coated with molten metal 80 by positioning means 64. Positioning means 64 may include a pair of sleds 66 for carrying coating tray 50,52, means 67 including a hydraulic motor 69 for rotating the coating tray and the coating tray being rotatably supported by bearings 68. One end of the bottom of sled 66 may include serrations 70 for being engaged by a toothed gear 72 and the other end of the bottom of sled 66 may be supported by a base plate 73. Base plate 73 also may support insulation 71. When it becomes necessary to position departure lip 84 adjacent to and transversely with the strip surface or to remove a coating tray from the coating assembly, sleds 66 are laterally displaced by rotating gear 72 by a motor 74. For example, it may be necessary to repair a coating tray or to replace the coating metal in a coating tray with a different type metal. It also may be necessary to reposition a coating tray relative to the strip during and after line stops, when the strip is damaged or to remove one of a pair of coating trays away from the strip when only one side of the strip is to be coated.

Strip 34 is held on a predetermined pass line by being moved upwardly through a sealed slot 41 (FIG. 1) and transversely past the departure lip by stabilizing rollers 36. The strip may be flattened while moving along this pass line by adjusting the stabilizing rollers. A coating tray is positioned at the coating station with the departure lip being fixed at a predetermined distance away from the strip. When opposing coating trays are used to coat both surfaces of the strip, the stabilizing rollers preferably cause the strip to pass midway between the opposing departure lips. Depending upon strip condition, occasional inadvertent contact may occur between the strip and the departure lips. When such contact occured in the trials discussed below, the flow of the molten metal from the contacted coating tray to the strip surface was not interrupted. Nevertheless, contact should be avoided as much as possible to minimize lip wear. If the departure lip is made of metal, metal abraded from the strip surface may build up on the departure lip and interrupt molten metal flow. Metal build up should not occur if the departure lip is made of a non-wetting material, e.g., ceramic.

Figure 7:
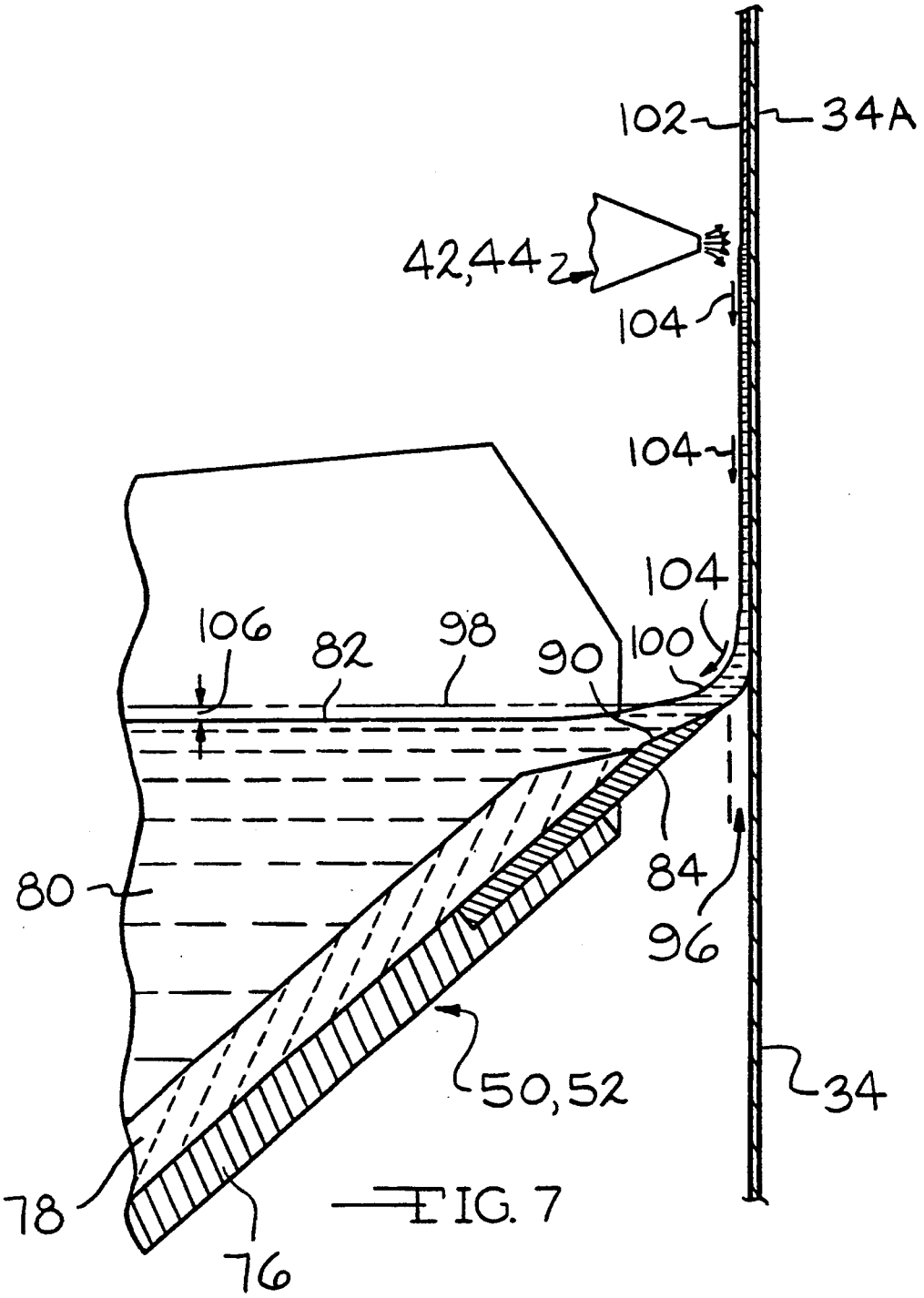
FIG. 7 is a view similar to FIG. 6 illustrating molten metal being coated onto the traveling strip by meniscus contact.
Figure 8:
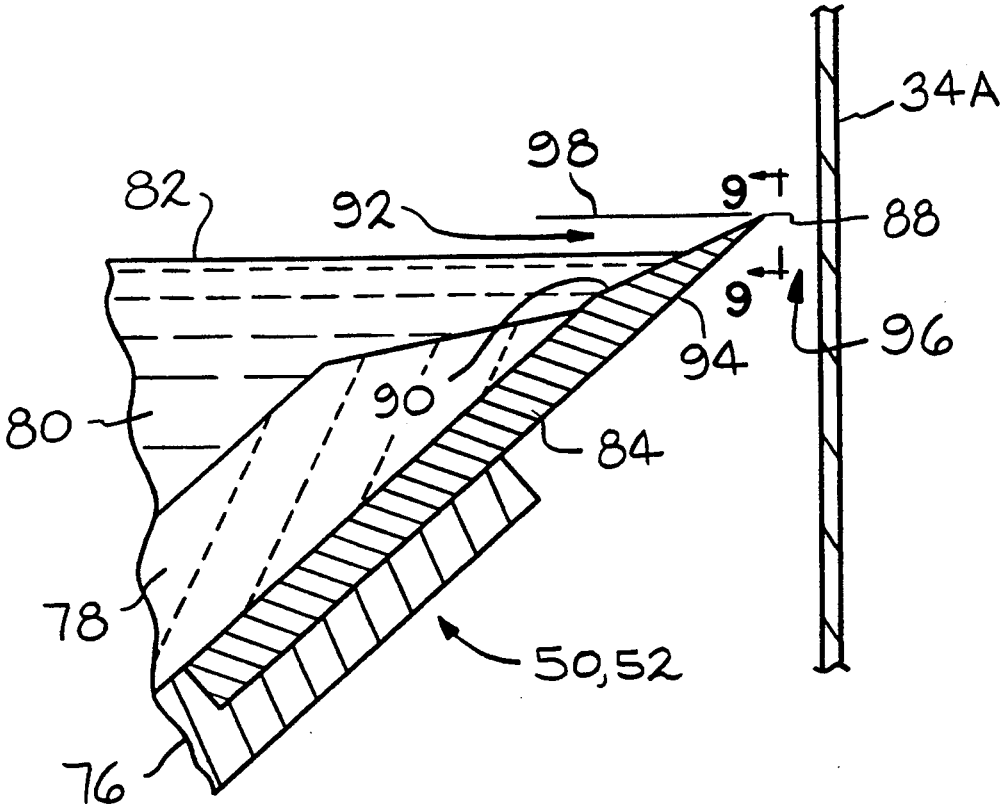
FIG. 8 is a view similar to FIG. 6 illustrating details of the molten metal departure lip.

FIGS. 7 and 8 are detailed views similar to FIG. 6 illustrating a preferred embodiment of departure lip 84 and the normal molten metal operating level in a coating tray. FIG. 7 illustrates molten metal being coated onto strip 34 moving in an upward direction by meniscus contact with molten metal 100 being pulled from coating bath 80 and flowing across departure lip 84 onto moving strip 34. The thickness of the molten coating metal remaining on the strip surface is controlled by pressurized gas directed toward as-coated strip 34A from finishing nozzle 42,44 forming a thin coating layer 102 having a smooth surface and uniform thickness. Excess molten metal as indicated by arrow 104 is recirculated downwardly along the strip surface without disrupting meniscus flow layer 100. Surface 82 of bath 80 is maintained at a distance 106 up to about 7 mm above to about 13 mm below a terminal end 88 of departure lip 84. Sharp terminal end 88 is positioned adjacent to and transversely with a planar surface of strip 34. Departure lip 84 is a rectangular steel member attached to liner 76 having a chamfered upper surface 90. Planar surface 90 preferably is inclined at an acute angle 92 of at least 15°, more preferably 35°–45° and most preferably about 40° relative to the horizontal plane of coating trays 50,52. Angle 92 encourages excess molten metal recirculation to coating tray 50,52 and encourages molten metal return to bath 80 from departure lip 84 when the travel of strip 34 is interrupted. Angle 92 should not be greater than about 50° to prevent molten metal drop along the longitudinal edges of the strip and to maintain uninterrupted surface tension between the molten metal and the steel substrate. Depending upon a number of factors such as the aggressiveness of the molten coating metal, line speed and molten coating metal temperature, surface 90 may be a non-wettable material such as the ceramic material of lining 78 of coating tray 50,52. The rectangular steel member could be replaced with ceramic lining 78 extending to terminal end 88. The lining 78 would be machined to provide planar surface 90 and the required sharp terminal end 88. Unlike some of the prior meniscus coating devices which use a restricted slot for delivering molten metal to the strip surface, the invention includes a departure lip having an open top with an inclined smooth upper surface and a sharp terminal end. An underlaying surface 94 of departure lip 84 may be inclined downwardly and away from the vertical plane of strip 34 so that the terminal end 88 forms an acute angle, preferably more than 30°. The underlying acute angle is advantageous because it discourages metal drop, benefits separation of the atmosphere zones above and below slot 41 with or without sealed chamber 38 and encourages stability of the meniscus should bath surface undulation occur when make-up metal is added to bath 80. The sharp edge discourages metal drop from terminal end 88 into a gap 96 between terminal end 88 and the surface of strip 34 as well as discourages metal drop along the longitudinal edges of strip 34. Depending upon the molten metal type, auxiliary heating of the departure lip may be necessary to prevent freezing of the molten metal as it flows over terminal end 88 of departure lip 84. This heating may be provided by a device immersed in bath 80 or by a device in thermal contact with the departure lip. Similar auxiliary heating may be provided for runner 54 and siphon tube 56 as well.

Molten metal is maintained in the coating tray at a predetermined level relative to the upper elevation of the departure lip so that an uninterrupted flow of molten metal is delivered to the strip surface. At the start of a coating sequence, the level of the bath is raised to a height above the upper elevation of the departure lip, such as by rotating the coating tray (FIGS. 11A–11C) or creating a wave, until molten metal flows over the departure lip and contacts the strip surface. As soon as the molten metal contacts the strip surface, the bath may be maintained at a level slightly above the upper elevation of the departure lip or allowed to fall to a height slightly below the upper elevation of the departure lip. As coating of the strip continues, molten metal removed from the coating tray is continuously or periodically replaced with make-up metal.

At the start of a coating sequence, horizontal surface 82 of bath 80 was elevated about 3 mm above upper elevation 98 of terminal end 88 of departure lip 84 so that molten metal flowed over departure lip 84 and contacted the surface of strip 34. A convenient way of elevating the molten bath in the laboratory was to impart a wave to the bath surface using a paddle. Wetting of the molten metal to the clean surface of strip 34 caused traveling strip 34 to carry the molten metal from the coating tray over the departure lip. Strip 34 will carry the molten metal without interruption so long as level 82 of the molten metal does not drop below that necessary for maintaining the surface tension between the molten metal and the strip surface. As soon as the molten metal contacts the surface of strip 34, the level of bath 80 is maintained at a predetermined operating level such as level 82 illustrated in FIGS. 6–8. Depending upon the molten metal type, the predetermined operating level 82 of the molten metal can be as much as about 13 mm below upper elevation 98 of terminal end 88 of departure lip 84 to as much as about 7 mm above upper elevation 98 of terminal end 88 of departure lip 84. The upper and lower limits depend upon factors such as surface tension of the molten metal, line speed, molten metal type and molten metal temperature. A preferred operating level 82 of the molten metal is about 3–6 mm below elevation 98 of the departure lip. During an interruption of travel of strip 34, molten metal flow to the strip surface would be interrupted but metal drop into the gap between the departure edge and the strip will not occur so long as gap 96 is no greater than about 8 mm. Preferably, gap 96 between terminal end 88 and the strip surface is at least 3 mm to minimize contact between departure lip 84 by the surface of strip 34. Stabilizing rollers 36 maintain strip 34 at the predetermined distance, i.e., gap 96, away from departure lip 84 for most strip surface conditions and stabilizes the strip pass line, i.e., presents a flat strip surface adjacent to the departure lip. Unlike conventional immersion coating processes, uppermost stabilizing roller 36 can be positioned within 30 cm or less, e.g., 6 cm, to the bottom of departure lip 84 thereby preventing gap 96 of the strip pass line from fluctuating so that a uniform coating thickness can be provided by finishing nozzles 42,44. Uniform coating thickness is essential for producing galvannealed steel strip. For two side coating, the stabilizing rollers allow the strip to be passed substantially equidistant between an opposing pair of departure lips. The surface of stabilizing rollers 36 is provided with a non-wetting material such as zirconium oxide so that molten metal will not stick to the roller surface in the event metal drop into gap 96 does occur. The non-wetting material prevents damage to the strip surface by the stabilizing rollers.

Figure 9:
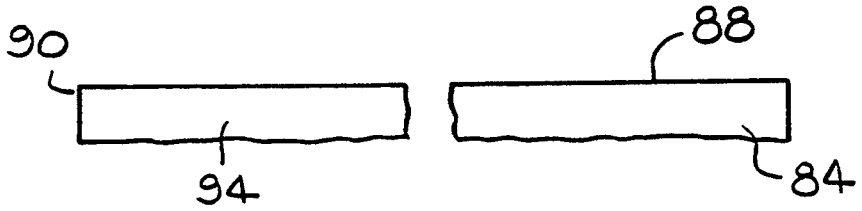
FIG. 9 is a view of a straight departure lip taken along line 9—9 of FIG. 8.

FIG. 9 is a side view of departure lip 84 taken along line 9—9 of FIG. 8. Elongated or straight terminal end 88 has a uniform thickness and extends horizontally across the width of coating trays 50,52 for delivering molten metal transversely across the entire width of the steel strip. The width of terminal end 88 of departure lip 84 must be sufficiently wide to accommodate all possible strip widths to be coated by the manufacturer. On a commercial coating line, this width may be as much as 180 cm or more. Replacing coating trays to meet scheduling requirements for strip of different widths is unnecessary since metal flows from the departure lip according to the strip width but metal drop from the departure lip does not occur beyond longitudinal edges of the strip. On a conventional immersion coating line, customer orders requiring strip of different widths normally are scheduled with strip having decreasing width with the amount of decrease permitted between each customer order being small. Strip of any width can be sequentially scheduled using the meniscus coating line of the invention.

Continuous, straight terminal end 88 of FIG. 9 may be replaced by a departure lip having a profiled terminal end so that one or more longitudinally extending stripes of molten metal are delivered to a strip surface. For example, one or more slots having a lower elevation and intermediate portions having a higher elevation can be provided across the width of the terminal end of the departure lip. The level of surface 82 of bath 80 could be maintained so that molten metal would flow through the lower elevation slot to that portion of the strip surface adjacent to the slot but would not flow over the higher elevation portion on either side of the slot. The portion of the strip surface passing adjacent to a slot would be coated with a metal stripe having a width corresponding to the width of the slot. This feature allows one or more stripes of a predetermined width to be applied to a strip surface at a predetermined location.

Figure 10:
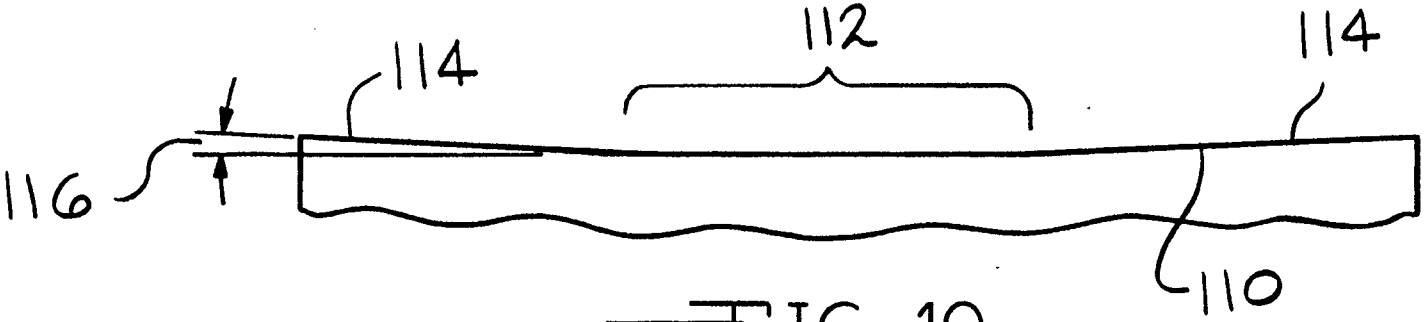
FIG. 10 is a view similar to FIG. 9 illustrating a tapered departure lip.

FIG. 10 is a side view similar to FIG. 9 of another embodiment of a departure lip of the invention. Unlike departure lip 84 of FIG. 9 having straight terminal end 88, a departure lip 108 of FIG. 10 has a profiled terminal end 110. Terminal end 110 includes a straight center portion 112 and tapered end portions 114 having a slightly upward rise. Central portion 112 corresponds to a width less than the narrowest strip width to be coated. Each of tapered end portions 114 slope upwardly to a rise 116 as high as 10 mm above the horizontal elevation of central portion 112, extending to a position at least 50 mm past the longitudinal edge of the widest strip to be coated. A preferred rise is 1–7 mm and the most preferred rise is 1.5 mm. Profiled departure lip 108 having rise 116 on both ends of straight central portion 112 enhances the initial meniscus contact with the strip surface during start up and discourages metal flow onto and around the strip longitudinal edges. Minimum molten metal flows onto the strip edges because the height of meniscus flow layer 100 is reduced at each strip surface by tapered ends 114 compared to the meniscus height along straight central portion 112. Unlike immersion coating where the strip longitudinal edges are completely coated with molten metal, tapered profiled departure lip 108 of the invention allows the operator to prevent metal flow onto the strip longitudinal edges or to cause metal to flow a predetermined transverse distance away from the strip longitudinal edges. This allows coating metal to be saved when it may be advantageous not to coat the strip edges such as when strip edges are to be trimmed or form hold down areas during fabrication of pans. In the former situation, side trim scrap can be recycled without introducing coating metal into a steel making furnace.

Figure 11C:
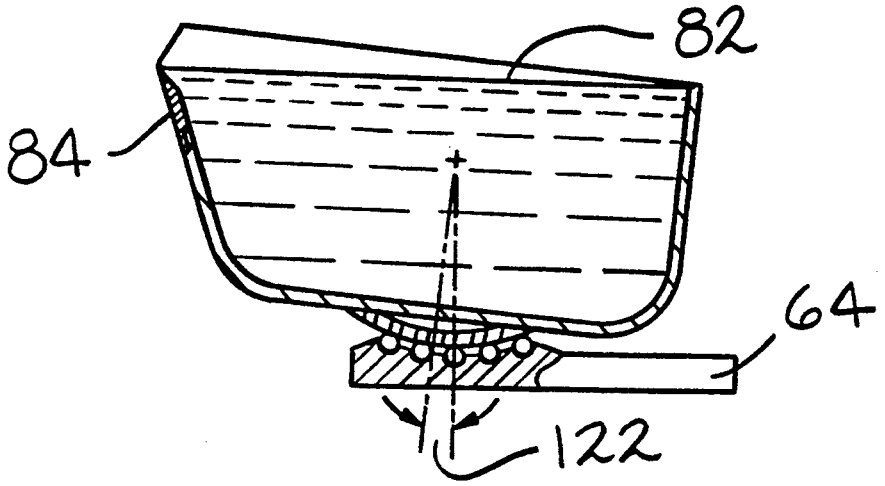

It was indicated above the level of the bath could be raised to a height above the upper elevation of the departure lip at the start of a coating sequence by rotating the coating tray. FIGS. 11A–11C illustrate three different coating tray positions provided by the rotational feature of positioning means 64. FIG. 11A illustrates the operating position wherein the coating tray is level with axis 118 being perpendicular to the horizontal. FIG. 11B illustrates the coating tray being rotated counterclockwise such as by motor 67 through an angle 120 of about 5° causing metal level 82 to rise above and over the terminal end of departure lip 84. This counterclockwise rotation can be used at the start of a coating sequence to establish meniscus contact between the molten metal and the steel strip. As soon as meniscus contact is established, the coating tray can be rotated in the opposite direction to the position illustrated in FIG. 11A. FIG. 11C illustrates the coating tray being rotated clockwise an angle 122 of about 5° causing metal level 82 to drop more than 13 mm below the terminal end of departure lip 84. This clockwise rotation can be used at the end of a coating sequence to break meniscus contact between the molten metal and the steel strip. The rotational feature of the coating tray also can advantageously be used to change the upper acute angle 92 of departure lip 84 when changes of strip speed occur.

Figure 12:
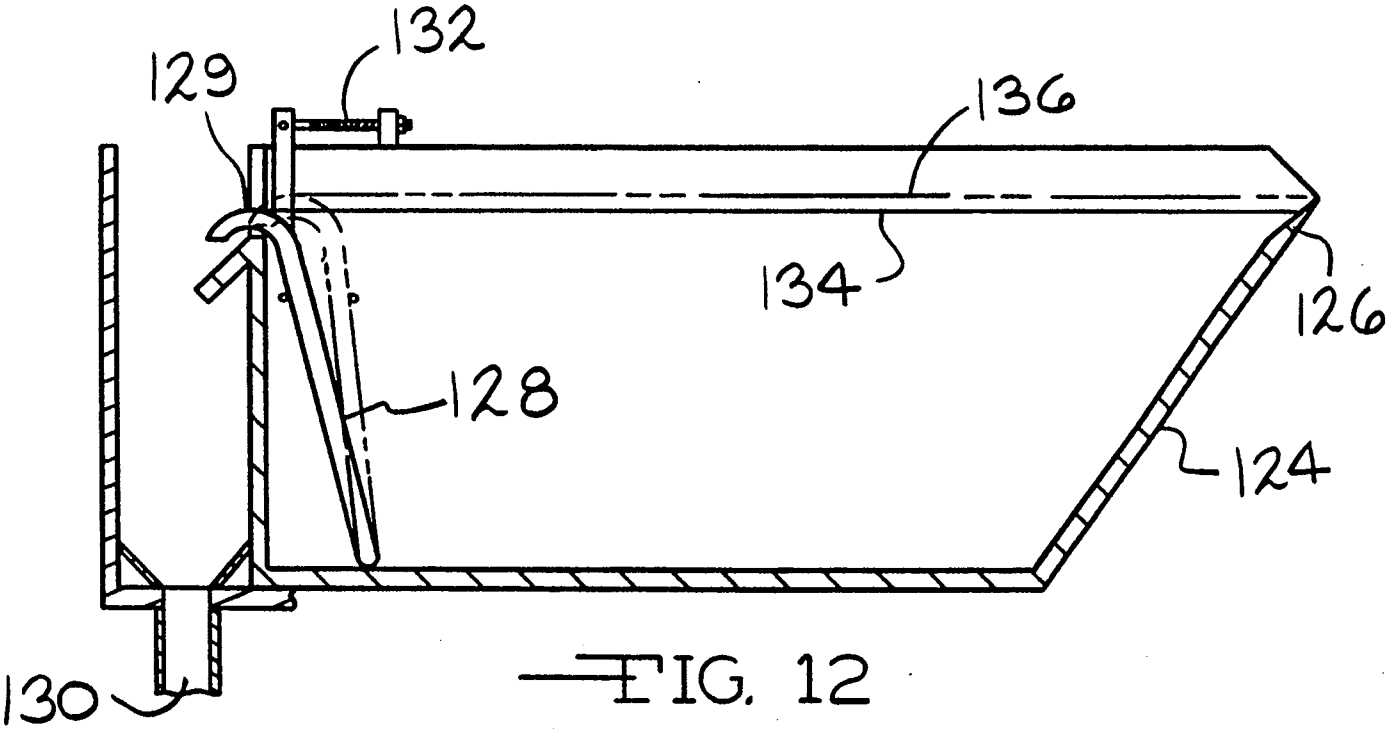
FIG. 12 illustrates a section view of another embodiment for controlling the level of the molten metal in a coating tray.

FIG. 12 illustrates a section view of means for controlling the level of molten metal in a coating tray 124 having a departure lip 126. The metal level control means includes a rotatable weir 128 and a molten metal return 130. Make-up metal may be periodically or continuously added to coating tray 124 with any excess metal flowing over top portion 129 of weir 128 into metal return 130 to be recycled to the coating tray. Weir 128 advantageously also can be used to raise or lower the metal level in the coating tray. For example, metal level 134 illustrates the normal operating level being at an elevation slightly below the upper elevation of departure lip 126. At the start of a coating sequence, the bath may be raised to level 136 slightly above the upper elevation of the departure lip by rotating weir 128 in a clockwise manner by a screw 132 to the position illustrated by phantom lines.

By way of examples, details of the invention now will be demonstrated. Low carbon, aluminum killed steel strip having a thickness of 0.56 mm and a width of 127 mm was two sides meniscus coated using the invention on a laboratory coating line similar to that illustrated in FIG. 1. The operating conditions for preparing steel strip 34 on coating line 20 were as follows: direct fired furnace 22 was heated to 1100° C.; radiant tube furnace 24 was heated to 980° C.; furnace 24, cooling section 26 and snout 28 contained a non-oxidizing atmosphere having a ratio by volume of $N_2/H_2$ of 1.5:1; the atmosphere temperature of furnace 26 was 980° C.; the peak strip temperature was 691° C.; the strip was cooled in section 26 and snout 28 to a temperature of 482° C. immediately prior to passing steel departure lips 84. The molten metal in each coating tray was a zinc alloy containing 0.20 wt. % aluminum. The temperature of the molten zinc was maintained at 466° C. using gas heaters positioned above the molten bath in each of coating trays 50 and 52. Nozzles 42 and 44 using nitrogen gas were used to control the thickness of the zinc coating layer on both surfaces of strip 34 with the atmosphere inside sealed coating chamber 38 containing less than 90 ppm oxygen having a dew point of −40° C. Precautions were taken to maintain gas separation between the coating trays and the furnace. Safety devices were installed to detect hydrogen migration from the furnace into sealed area 40. Sealed area 40 was purged with nitrogen and differential pressures were used to maintain gas separation between the coating trays and and sealing means 62. Surface 90 of steel departure lips 84 had an acute angle of about 40° relative to the horizontal plane of the coating trays. Each departure lip had a width of about 200 mm. The strip was positioned a distance of about 3 mm from terminal end 88 of each departure lip 84. Surface 82 of zinc bath 80 in each coating tray 50 and 52 was maintained at a height of about 4 mm above upper elevation 98 of departure lip 84 by periodically dipping a small quantity of molten zinc from a premelting furnace and pouring into an exposed portion of each of the coating trays a distance away from the departure lips.

Example 1

The strip was passed through the laboratory coating line at various speeds with the thickness of molten zinc flow layer 100 visually determined to be between about 6–13 mm. Excess molten zinc 104 having a very light coating oxide patina was recirculated from the strip surface back into flow layer 100. Good quality coating having a uniform thickness was obtained regardless of the flow layer thickness. Near the end of the trial, the strip was cooled to a temperature less than 482° C. immediately prior to passing the departure lips and being coated with molten zinc to determine if a Zn-Fe interface alloy could be eliminated. At a strip temperature of 471° C., the Zn-Fe interface alloy still formed.

Example 2

In another example, the strip was coated with molten zinc as described in Example 1 except the surface of the molten metal in the coating trays was about 3 mm above to the upper elevation of the departure lip. The strip initially was passed through the laboratory coating line at a speed of about 6 m/min with the thickness of molten zinc flow layer 100 visually determined to be approximately 3 mm. Delivery of the molten zinc to the strip surface was interrupted and molten zinc dropped into gap 96. When the strip speed was increased to about 18 m/min, the thickness of the molten zinc meniscus increased to approximately 6 mm and delivery of the molten zinc to the strip surface was not interrupted.

Example 3

In another example, the strip was coated with molten zinc as described in Example 2 except the strip had a thickness of 0.38 mm and each of the departure lips was positioned approximately 1.5 mm from a strip surface. The strip initially was passed through the laboratory coating line at a speed of about 12 m/min with the thickness of molten zinc flow layer 100 visually appearing to be approximately 10 mm. The strip speed then was increased to about 23 m/min and the thickness of the molten zinc flow layer 100 increased to approximately 13 mm. Delivery of molten zinc to the strip surfaces was not interrupted, except for a brief period of time, even when the strip had wavy edges having an amplitude of about 3 mm or when undulations were imparted to the surface of the molten zinc. The flow layer followed the strip as it undulated toward and away from the terminal end of each of the departure lips. During the brief metal flow interruption referred to above, metal drop occurred when molten zinc did not wet the steel strip. This was associated with poor strip preparation wherein oxidized areas on the strip surface were not completely cleaned in furnace sections 22 and 24. The coating trays then gradually were laterally repositioned until the terminal end of each departure lip was about 6 mm away from the surface of the strip. At this position, flow of the molten zinc was interrupted because of strip wavy edge.

Example 4

In another example, the strip was coated as described in Example 1 except low carbon, titanium stabilized steel strip having a thickness of 0.56 mm and a width of 127 mm was used, the coating trays contained commercially pure zinc (99.99 wt. %) and the strip was cooled to 500° C. immediately prior to being coated with the molten zinc. The strip was passed through the laboratory coating line at a speed of 6 m/min and received a coating weight of 90 g/m$^2$ on each surface of the strip. The purpose of this trial was to determine whether galvanized strip could be in-line galvannealed without post heating. After being coated with the molten zinc, the coating was completely alloyed in about 20 seconds without additional heat input required. The strip then was cooled to below 290° C. in about 4 seconds to stop the interdiffusion of zinc and iron.

Example 5

In another example, the strip was coated as described in Example 4 with molten commercially pure aluminum applied to one side of the strip. The strip was cooled in section 26 and snout 28 to a temperature of about 675° C. immediately prior to passing a departure lip and the temperature of the molten aluminum in the bath was about 675° C. A jet nozzle using nitrogen gas were used to control the thickness of the aluminum coating. The atmosphere inside sealed coating chamber 38 had less than 100 ppm oxygen. When passing the strip through the coating line at a constant speed of 12 m/min, an aluminum coating thickness of about 25 microns was obtained. The finishing gas pressure in the jet nozzle then was adjusted to obtain an aluminum coating thickness of about 130 microns. Delivery of the molten aluminum to the strip surface was not interrupted by the finishing gas and metal drop from the departure edge did not occur. Coating quality and coating adherence were good for both of the steels having 25 microns and 130 microns coatings. Interfacial iron alloy layer thickness for both coating layers was similar to immersion practice. However, the high purity, i.e., low iron content, of the unalloyed outer portions of each of the coating layers contributed to the superior coating formability.

Example 6

In another example, the strip was coated with molten pure tin as described in Example 4 only on one surface. The strip was cooled to about 425° C. and the molten tin in the coating tray was maintained at a temperature of about 320° C. When passing through the coating line at a constant speed of 12 m/min, the strip received a tin coating weight of 15 g/m$^2$. The coating weight was increased to 35 g/m$^2$ by decreasing gas pressure in the jet nozzle. Delivery of the molten tin to the strip surface was not interrupted and metal drop did not occur. The coating surface was smooth and bright and the coating layer was uniform in thickness. When each of the steels having 15 g/m$^2$ and 35 g/m$^2$coatings was formed into cups, coating adherence was excellent without the undesirable crazing typical for electrodeposited tin coatings.

Example 7

In another example, the strip was coated with molten pure tin as described in Example 6 except the strip was coated on both surfaces, the strip was cooled to about 425° C. and the molten tin in both coating trays was maintained at a temperature of slightly less than 320° C. Delivery of the molten tin to the strip surfaces was not interrupted by the finishing gas and metal drop did not occur from the departure edge. Delivery of the molten tin became interrupted when the gap between one of the departure lips and the strip surface was increased to greater than about 3 mm. Increasing the strip temperature and the tin bath temperature resulted in the tin coating having a rough (porous) surface and having a tinted (oxidized) color.

Example 8

In another example, the strip was coated as described in Example 6 except the strip was coated with a duplex coating of molten commercially pure tin on one surface of the strip and a molten alloy of 8 wt. % tin and 92 wt. % lead on the other surface, the strip was cooled to a temperature of about 425° C., the molten pure tin in the one coating tray was maintained at a temperature of about 300° C. and the molten tin-lead alloy in the other coating tray was maintained at a temperature of about 340° C. Molten metal flow from neither coating tray was interrupted when the strip was passed through the coating line at a speed of 9 m/min, metal drop along neither of the strip surfaces occurred and the duplex coating formed was adherent during ball impact tests.

Example 9

In another example, a steel strip was coated with a duplex coating similar to that described in Example 8 except the molten tin-lead metal was replaced by molten zinc alloy containing 0.2 wt. % aluminum, the strip was cooled to a temperature of about 445° C., the molten pure tin in the one coating tray was maintained at a temperature of about 380° C. and the molten zinc in the other coating tray was maintained at a temperature of about 445° C. Molten metal flow from neither coating tray was interrupted when the strip was passed through the coating line at a speed of 9 m/min, metal drop along neither of the strip surfaces occurred and the duplex coating formed was adherent during ball impact tests. Because a tin coating oxidizes at elevated temperatures, pure molten tin preferably should be maintained at a temperature of about 290°-315° C. in the coating tray.

Examples 8 and 9 demonstrate an important feature of the invention is the ability to produce a duplex coating, i.e., having a different molten metal type on opposite sides of the strip. Since two side coating of the invention uses independent coating trays for each side of the strip, one coating tray could be used to coat one side of a strip with a first metal such as pure tin and the other coating tray could be used to coat the opposite side of the strip with a second metal such as zinc. In Example 9, the tin coated side had excellent formability and should have good corrosion performance when exposed to alcohol containing fuels while the zinc coated side should protect against roadway salt as required for chassis underside components such as automobile fuel tanks. Unlike electroplated tin which tends to have poor crazing resistance, meniscus coated tin had good formability because of a dense cast structure.

A duplex galvanized steel strip having a zinc coating unalloyed with iron, on one surface of the strip and a zinc iron alloy coating on the other surface the strip similarly could be produced. A steel strip could be coated using coating trays with one of the trays containing essentially molten zinc having low aluminum, i.e., <0.15 wt. % Al such as commercially pure zinc, and the other the trays containing a molten zinc alloy having high aluminum, i.e., ≧0.15 wt. % Al. The low aluminum containing molten zinc will form a zinc-iron alloy coating by interdiffusion of iron and zinc at a temperature substantially less than that of the high aluminum containing molten zinc. For example, molten commercially pure zinc can be completely alloyed with iron at a temperature as low as 500° C. while molten zinc containing 0.20 wt. % Al requires a temperature of 550° C. or more to be completely alloyed with iron. By controlling the strip temperature to less than 550° C., preferably about 515° C., a zinc iron alloy coating can be formed on the strip surface coated with the low aluminum containing molten zinc while the opposite surface coated with the high aluminum containing molten zinc will remain substantially unalloyed with iron.

For duplex coatings having substantially different melting points such as aluminum and zinc or zinc and tin, the coating trays on opposite sides of the strip preferably should be offset from one another along the vertical path of travel of the strip. The higher melting point coating can be applied to one strip surface from a lower positioned coating tray followed by coating the other strip surface with the lower melting point coating from a higher positioned coating tray. Means to cool the strip prior to being coated with the lower melting point molten metal may be provided between the coating trays to prevent excessive alloying of the lower melting point coating with the steel substrate. If the means for controlling coating thickness on two side steel strip are jet nozzles, the nozzles may be offset from one another as well. In the case of a duplex coating of aluminum and zinc, the steel strip could have a temperature of about 660° C. prior to being coated on one surface with aluminum. After being coated with aluminum, the strip could be cooled to a temperature as low as about 425° C. prior to being coated with zinc on the other surface. Since aluminum melts at about 660° C., the aluminum coating would be solidified when molten zinc is applied to the other strip surface. The jet nozzle for controlling the thickness of the aluminum coating layer would be positioned below the coating tray containing molten zinc. When coating with a duplex coating of tin and zinc (Example 9), zinc could be coated onto one surface of the strip first. The strip then could be cooled from about 425° C. to no more than about 325° C. before coating tin onto the other strip surface. Depending upon the melting temperature difference of the duplex coatings and the gas pressure being used to control the coating layer thickness, the lower positioned jet nozzle may sufficiently cool the strip prior to applying the second coating metal. Various other means also could be used for additional cooling such as a chill roll.

Examples 10–16

In additional trials, low carbon, aluminum killed steel strip was coated with molten pure zinc on both surfaces on a commercial size coating line using the invention. The operating conditions for preparing the steel strip were as follows: direct fired furnace 22 was heated to about 1150° C.; radiant tube furnace 24 was heated to about 968° Cl; furnace 24, cooling section 26 and snout 28 contained a non-oxidizing atmosphere having a ratio by volume of $N_2/H_2$ of 7:1; molten zinc in coating trays 50 and 52 contained 0.20 wt. % aluminum; the temperature of the molten zinc in the coating trays was maintained by recirculating make-up metal having a temperature of 460° C. from an immersion coating pot; coating trays 50,52 were enclosed within sealed chamber 38 containing a non-oxidizing nitrogen atmosphere having a dew point no greater than −33° C.; about 35 kPa nitrogen gas was used in nozzles 42,44 to control the thickness of the zinc coating layer on both surfaces of the strip; surface 90 of departure lip 84 of each of the coating trays had an acute angle of about 40° relative to the horizontal plane of the coating trays; the strip was maintained a distance of about 6 mm from terminal end 88 of each departure lip 84; surface 82 of zinc bath 80 in each of the coating trays was maintained within the range of no more than 7 mm above and no less than 6 mm below upper elevation 98 of each departure lip 84 by periodically pumping zinc from the immersion coating pot. Variables for each steel strip of the examples are summarized in Table 1.

TABLE 1

| Example | Coil Size | LS m/min | PMT° C. | ST° C. | Snout | Chamber |
|---|---|---|---|---|---|---|
| 10 | 0.86 mm × 99 cm | 57 | 882 | 493 | 420 | 140 |
| 11 | 0.86 mm × 122 cm | 57 | 899 | 527 | 420 | 100 |
| 12 | 0.86 mm × 122 cm | 65 | 871 | 477 | 400 | 80 |
| 13 | 0.86 mm × 122 cm | 74 | 877 | 516 | 400 | 70 |
| 14 | 0.86 mm × 122 cm | 74 | 871 | 454 | 400 | 70 |
| 15 | 0.86 mm × 152 cm | 74 | 877 | 477 | 400 | 70 |
| 16 | 0.86 mm × 152 cm | 91 | 899 | 474 | 400 | 70 |

LS—coating line speed
PMT—peak strip temperature
ST—strip temperature at departure lips
Snout—ppm of oxygen in snout 28
Chamber—ppm oxygen in enclosed chamber 38

Delivery of molten zinc to the strip surfaces was not interrupted by the finishing gas and good material was produced without metal drop occuring from the departure lips along the strip edges. The width of the strip increased from 99 cm in Example 10 to 122 cm in Example 11 and subsequently was increased to 152 cm in Example 15. The transition between steel strips when each of the large width changes occurred was without incident. Meniscus contact across the full width of the wider strip occured almost immediately when the strip width change occured.

A zinc iron alloy was formed on the steel surface of the strip during the production of Examples 11 and 13 without the use of post heating. This was accomplished by bringing the strip past the departure lip at elevated temperatures of 527° C. 516° C. respectively. The coating contained 11 wt. % iron and 0.22 wt. % aluminum and exhibited exposed quality galvanneal powdering properties.

Example 17

In another example, steel strip was coated with commercially pure zinc as described in Example 4 except the strip was passed through the laboratory coating line at a line speed of 10 m/min and received a coating weight of 60 g/m$^2$ on one side of the strip. The strip had a temperature of 515° C. when passing the departure lip. The zinc coating became completely alloyed to zinc iron after 15 seconds without additional heat input required. The strip then was allowed to cool in the laboratory atmosphere. The microstructure of this meniscus coated zinc iron alloy of the invention was formed to zeta and delta phase zinc with minimal or no brittle gamma phase being formed. FIG. 13 is a pictorial representation using a standard tape test to compare the powdering behavior of the galvannealed steel of this example to a typical galvannealed steel made from an immersion coating process using post heating. FIG. 13 clearly demonstrates the material made according to the invention was found to have minimal powdering compared to typical galvannealed steel made from an immersion coating process.

It was indicated above metal drop can be prevented when the spacing between the departure lip and the strip surface is maintained at not more than about 8 mm. This is assuming that the molten metal makes good wetting contact with the strip surface. Example 6 demonstrated that cleaning of the strip is critical to insure that the molten metal properly wets the strip surface.

On a conventional immersion coating line, the temperatures of the incoming strip and the coating bath must support wetting of the strip without freezing the bath or contributing to excessive interfacial coating alloy formation. Steel strip normally is at a temperature near or slightly above the melting point of the coating metal prior to entering the molten bath to prevent removing heat from the bath. Immersion coatings of zinc or aluminum tend to develop poor adherence at higher temperatures, a condition aggravated by dwell time in the molten bath. One of the advantages of meniscus coating of the present invention is no such strip temperature limitation. The requirement is to provide for wetting of the strip by the coating metal and for good coating flow when being finished by the jets. Lower strip temperatures do not adversely affect the bath and discourage excessive interfacial iron alloy layer growth. Since the strip does not enter into the bath, higher strip temperatures advantageously can be used to supply energy to the diffusion process for galvannealing.

A disadvantage of conventional immersion coating is that molten metal in the bath becomes contaminated with iron. Dissolution of iron occurs when the heated steel strip passes through the coating bath. In galvanizing, dissolution of iron also occurs from the steel pot containing the molten zinc. A galvanizing bath may contain about 0.03 wt. % iron while an aluminizing bath may contain as much as 3 wt. % iron. Since the strip does not pass through a coating bath during the meniscus coating of the invention, it was determined that molten zinc or aluminum in a ceramic lined coating tray remains essentially free of iron. This results in no or minimal iron intermetallic formation in the bath for galvanizing and aluminizing operations. Metallic coated steel strip having an iron free coating layer results in a very adherent coating that is very formable, especially aluminum coated steel strip.

Conventional immersion coating to produce regular galvanized steel includes molten zinc containing at least 0.15 wt. % or more aluminum to inhibit formation of a thick intermetallic zinc iron alloy layer on the as-coated steel. The molten zinc bath for producing galvannealed steel normally includes aluminum as well but at substantially reduced concentrations. When regular galvanized strip and galvannealed strip are produced on a coating line using the same coating pot, the manufacturer is unable to completely eliminate all the aluminum from the zinc coating bath. Producing galvannealed strip on a conventional immersion zinc coating line also requires post heating equipment such as flame burners or an induction coil because high diffusion temperatures of 550° C. or more are necessary to form an iron containing zinc alloy coating when the zinc coating contains aluminum. A galvanized coating must be produced first then heated to make galvanneal. The composition of the molten zinc in the large coating pot required for a conventional immersion coating line cannot easily be altered. Because of the small volume of molten zinc in the coating tray of the invention, aluminum can be substantially eliminated from the molten zinc very quickly. Alternatively, the coating tray can quickly and easily be replaced with another coating tray filled with molten zinc without any aluminum. As demonstrated in Example 13, galvannealed steel can be produced from strip coated with molten zinc even when containing 0.15 wt. % or more aluminum when using the invention. In Example 13 for steel strip having a temperature of 515° C. and coated with zinc containing 0.20 wt. % aluminum, the coating layer was completely alloyed with iron in about 15 seconds to zeta and delta phase zinc with the formation of little, if any, brittle gamma phase. As soon as alloying of the coating was completed, the strip was rapidly cooled to stop the interdiffusion of iron. Thus, another important feature of the invention is to produce galvannealed steel strip having improved coating thickness uniformity in relatively short times, i.e., less than 30 seconds, using strip coating temperatures less than 550° C. without using post heating.

It will be understood various modifications can be made to the invention without departing from the spirit and scope of it. Steel strip can be one or two side coated. Two side coated strip may be coated with the same molten metal or a different molten metal type on each surface. The entire width of a strip surface may be coated with molten metal or stripes of molten metal may be coated across a strip surface. Therefore, the limits of the invention should be determined from the appended claims.

What is claimed is:

1. A method of meniscus coating at least one surface of steel strip with metal, comprising:

providing at least one horizontally disposed coating tray for coating only one surface of the strip with molten metal and having a departure lip, said departure lip having a width at least as wide as the strip and including an upwardly inclined upper surface elongated in the direction of the strip width, a lower surface, and a sharp terminal end defined by the intersection of said upper and lower surfaces positionable adjacent to and transversely with said one surface, said lower surface inclined downwardly and away from said strip for an entire length of said departure lip, providing said coating tray with molten metal, moving said strip transversely past said terminal end of said departure lip, wetting said one surface of said strip with said molten metal by meniscus contact so that said molten metal is pulled from said departure lip onto said one surface, and maintaining said molten metal in said coating tray at a level relative to the upper elevation of said terminal end of said departure lip so that a supply of said molten metal is available to be pulled from said coating tray as said strip moves past said terminal end.

2. The method of claim 1 wherein said level of said molten metal is maintained no more than 7 mm above and no more than 13 mm below said upper elevation of said departure lip.

3. The method of claim 1 wherein said departure lip is positioned 3–8 mm from said surface of said strip.

4. The method of claim 1 including the additional step of laterally displacing said coating tray relative to said strip.

5. The method of claim 1 including the additional step of stabilizing said strip relative to said departure lip.

6. The method of claim 5 wherein said strip is stabilized by passing said strip between a pair of rollers, said rollers being positioned below said departure lip on opposite sides of said strip and offset relative to one another.

7. The method of claim 1 including providing a plurality of coating trays.

8. The method of claim 7 wherein two of said coating trays are positioned on opposite sides of said strip whereby both surfaces of said strip are coated with said molten metal.

9. The method of claim 7 wherein one of said coating trays is positioned above another of said coating trays wherein said molten metal on said strip from said one coating tray is superimposed over said molten metal on said strip from said another coating tray.

10. The method of claim 7 wherein one of said coating trays is positioned above another of said coating trays, said one coating tray containing a different molten metal and including the additional step of cooling said strip after being coated with said molten metal from said another coating tray and prior to said strip being coated with said different molten metal from said one coating tray.

11. The method of claim 8 wherein said strip is passed substantially equidistant between the departure lips of said coating trays.

12. The method of claim 1 including the additional step of heating said strip to a temperature near the melting point of said molten metal prior to being moved past said departure lip.

13. The method of claim 1 including the additional step of cleaning said strip by heating in a reducing atmosphere to a temperature less than about 985° C.

14. The method of claim 1 including the additional step of blowing pressurized non-oxidizing gas toward said coated surface to control the thickness of the coating layer.

15. The method of claim 1 wherein said coating tray is enclosed in a chamber containing a non-oxidizing atmosphere.

16. The method of claim 1 including the additional steps of replacing said coating tray with another coating tray containing a different molten metal and positioning the departure lip of said another coating tray to within 3–8 mm of said surface.

17. The method of claim 1 wherein said molten metal is a zinc alloy and including the additional step of replacing said molten zinc alloy with commercially pure zinc.

18. The method of claim 1 wherein said molten metal is zinc and including the additional steps of cleaning said strip by heating in a reducing atmosphere, cooling said strip to a temperature less than 500° C., coating said heated strip with said molten zinc whereby a galvanize coating having no or minimal zinc iron alloy layer is formed.

19. The method of claim 1 wherein said level is maintained by adding make-up metal to said coating tray.

20. The method of claim 19 wherein said make-up metal is a liquid.

21. The method of claim 19 wherein said make-up metal is a solid.

22. The method of claim 19 wherein any excess make-up metal is recirculated.

23. The method of claim 1 including the additional step of heating said departure lip.

24. The method of claim 1 wherein said departure lip has a profiled terminal end.

25. The method of claim 24 wherein the longitudinal edges of said strip are not contacted by said molten metal coated onto said surface.

26. The method of claim 24 wherein said profiled departure lip is tapered.

27. The method of claim 24 wherein said profiled departure lip includes a slot for delivering a longitudinally extending stripe of said molten metal on said strip surface.

28. A method of meniscus coating at least one surface of steel strip with metal, comprising:

providing at least one horizontally disposed coating tray for coating only one surface of the strip with molten metal and having a departure lip, said departure lip having a width at least as wide as the strip and including an upwardly inclined upper surface elongated in the direction of the strip width, a lower surface, and a sharp terminal end defined by the intersection of said upper and lower surfaces positionable adjacent to and transversely with said one surface, said lower surface inclined downwardly and away from said strip for an entire length of said departure lip, providing said coating tray with molten metal, moving said strip transversely past said terminal end of said departure lip, wetting said one surface of said strip with said molten metal by meniscus contact so that said molten metal is pulled from said departure lip onto said one surface, maintaining said molten metal in said coating tray at a level relative to the upper elevation of said terminal end of said departure lip so that a supply of said molten metal is available to be pulled from said coating tray as said strip moves past said terminal end, replacing said coating tray with another coating tray containing a different molten metal, and coating said different molten metal onto said one surface.

29. A method of meniscus coating at least one surface of steel strip with metal, comprising:

providing at least one horizontally disposed coating tray for coating only one surface of the strip with molten metal and having a departure lip, said departure lip having a width at least as wide as the strip and including an upwardly inclined upper surface elongated in the direction of the strip width, a lower surface and a sharp terminal end defined by the intersection of said upper and lower surfaces, said terminal end positionable adjacent t and transversely with said one surface, said lower surface inclined downwardly and away from the vertical plane of said strip for an entire length of said departure lip, providing said coating tray with molten metal, cleaning said strip by heating to a temperature less than bout 985° C. in a reducing atmosphere, moving said heated strip transversely past within 3–8 mm of said terminal end of said departure lip, wetting said one surface of said strip with said molten metal by meniscus contact so that said molten metal is pulled from said departure lip onto said one surface, maintaining said molten metal in said coating tray at a level relative to the upper elevation of said terminal end of said departure lip so that a supply of said molten metal is available to be pulled from said coating way as said snip moves past said terminal end, and blowing pressurized gas toward said coated surface to control the thickness of the molten coating.

30. A method of meniscus coating at least one surface of steel strip with metal, comprising:

providing at least one horizontally disposed coating tray for coating only one surface of the snip with molten metal and having a departure lip, said departure lip having a width at least as wide as the snip and including an upwardly inclined upper surface elongate in the direction of the strip width, a lower surface and a sharp terminal end defined by the intersection of said upper and lower surfaces, said terminal end positionable adjacent to and transversely with said one surface, said lower surface inclined downwardly and away from the vertical plane of said strip for an entire length of said departure lip, providing said coating way with molten metal, cleaning said strip by heating m a temperature less than about 985° C. in a reducing atmosphere, moving said strip transversely past said terminal end of said departure lip, wetting the entire width of said one surface of said strip with said molten metal by meniscus contact so that said molten metal is pulled from said departure lip onto said one surface, maintaining said molten metal in said coating tray at a level no more than 7 mm above and no more than 13 mm below the upper elevation of said terminal end of said departure lip so that a supply of said molten metal is available to be pulled from said coating tray as said strip moves past said terminal end, and blowing pressurized gas toward said coated surface to control the thickness of the molten coating.

31. A method of meniscus coating both surfaces of steel snip with metal, comprising:

providing a spaced pair of horizontally disposed coating trays, each of said coating trays for coating one of the surfaces of the strip with molten metal and having a departure lip, each said departure lip having a width at least as wide as the strip and including an upwardly inclined upper surface elongated in the direction of the strip width, a lower surface, and a sharp terminal end defined by the intersection of said upper and lower surfaces positionable adjacent to and transversely with said one surface, said lower surface inclined downwardly and away from said strip for an entire length of said departure lip, providing each of said coating trays with a different molten metal, moving said strip transversely between said terminal ends of said departure lips, wetting the entire width of the surfaces of said strip with a molten metal by meniscus contact so that said molten metal is pulled from said departure lips onto said surfaces wherein each of said surfaces is coated with a different one of said molten metals, and maintaining said molten metal in said coating trays at a level relative to the upper elevation of said terminal ends of said departure lips so that a supply of said molten metal is available to be pulled from said coating trays as said strip moves between said terminal ends.

32. The method of claim 31 wherein one of said molten metals is tin and the other of said molten metals is zinc.

33. The method of claim 31 wherein one of said molten metals is zinc containing less than 0.15 wt. % aluminum and the other of said molten metals is a zinc alloy containing at least 0.15 wt. % aluminum.

34. A method of meniscus coating at least one surface of steel strip with metal, comprising:

providing at least one horizontally disposed coating tray for coating only one surface of the snip with molten metal and having a departure lip, said departure lip having a width at least as wide as the strip and including an upwardly inclined upper surface elongated in the direction of the strip width, a lower surface and a sharp terminal end defined by the intersection of said upper and lower surfaces, said terminal cad positionable adjacent to and transversely with said one surface, said lower surface inclined downwardly and away from the vertical plane of said strip for an entire length of said departure lip, maintaining said coating tray in a non-oxidizing atmosphere, providing said coating tray with molten metal, cleaning said strip by heating to a temperature less than about 985° C. in a reducing atmosphere, stabilizing said strip by moving between a pair of rollers with said one surface of said strip being moved transversely past said terminal end of said departure lip, said rollers being positioned below said departure lip on opposite sides of said strip, wetting the entire width of said one surface of said strip with said molten metal by meniscus contact so that said molten metal is pulled from said departure lip onto said one surface, maintaining said molten metal in said coating tray at a level no more than 7 mm above and no more than 13 mm below the upper elevation of said terminal end of said departure lip so that a supply of said molten metal is available to be pulled from said coating tray as said strip moves past said terminal end by adding make-up metal to said coating tray, and blowing pressurized non-oxidizing gas toward said coated surface to control the thickness of the molten coating.

35. A method of meniscus coating at least one surface of steel strip with metal, comprising:

providing at least one horizontally disposed coating tray having a departure lip, providing said coating tray with molten zinc, cleaning the strip by heating in a reducing atmosphere, cooling said strip to a temperature less than 550° C., moving said strip transversely past said departure lip, wetting a surface of said strip with said molten zinc by meniscus contact so that said molten zinc flows continuously from said departure lip onto said surface, interdiffusing iron from the substrate of said coated strip with the zinc coating, cooling said coated strip to substantially stop said diffusion whereby said zinc coating is completely alloyed with iron having no or minimal gamma phase zinc alloy using only the residual heat of said coated strip, and maintaining said molten zinc in said coating tray at a level relative to the upper elevation of said departure lip so that an uninterrupted flow of said molten zinc is delivered to said surface.

36. The method of claim 35 wherein said strip is cooled to no less than 515° C. prior to said coating step, the time of said interdiffusion being less than 30 seconds whereby said zinc iron alloy has no more than 13 atomic % iron.

37. A method of meniscus coating at least one surface of steel strip with metal, comprising:

providing at least one horizontally disposed coating tray for coating only one surface of the snip with molten metal and having a departure lip, said departure lip including an upwardly inclined upper surface elongated in the direction of the strip width and a sharp terminal end positionable adjacent to and transversely with said one surface, providing said coating tray with molten metal, rotating said coating way relative to said strip, moving said strip transversely past said terminal end of said departure lip, wetting said one surface of said strip with said molten metal by meniscus contact so that said molten metal is pulled from said departure lip onto said one surface, and maintaining said molten metal in said coating tray at a level relative to the upper elevation of said terminal end of said departure lip so that a supply of said molten metal is available to be pulled from said coating way as said strip moves past said terminal end.

38. A method of meniscus coating at least one surface of strip with metal, comprising:

providing at least one horizontally disposed coating tray having a departure lip, said coating tray containing molten zinc, providing a steel strip, heating said strip in a reducing atmosphere to remove oil, dirt, iron oxide and the like so that said strip is readily wetted by said molten zinc, moving said heated strip at a temperature less than 550° C. transversely past said departure lip, wetting a surface of said strip with said molten zinc by meniscus contact so that said molten zinc flows continuously from said departure lip onto said surface, maintaining said molten zinc in said coating tray at a level relative to the upper elevation of said departure lip so that an uninterrupted flow of said molten zinc is delivered to said surface, interdiffusing iron from said strip with the molten zinc coating on said surface and cooling said coated strip to substantially stop said interdiffusion whereby a galvannealed strip is formed using only the residual heat of said coated strip with the zinc coating being completely alloyed with iron and having no or minimal gamma phase zinc alloy.

39. The method of claim 38 including providing two coating trays, one of said coating trays being positioned on each side of said strip wherein both surfaces of said strip are coated with said molten zinc, said iron being completely interdiffused with said molten zinc coating of only one of said surfaces.

40. The method of claim 38 including providing two coating trays, one of said coating trays being positioned on each side of said strip wherein both surfaces of said strip are coated with said molten zinc, said iron being completely interdiffused with said molten zinc coating on both of said surfaces.

41. The method of claim 38 wherein said heated strip is cooled to no-less than 515° C. prior to being coated with said molten zinc, the time of said interdiffusion being less than 30 seconds whereby said zinc iron alloy contains no more than 13 atomic % iron.

42. The method of claim 38 including providing two coating trays, one of said coating trays being positioned on each side of said strip, said molten zinc in one of said coating trays having at least 0.15 wt. % aluminum and said molten zinc in the other of said coating trays having less than 0.15 wt. % aluminum, wherein said molten zinc flowed from said one coating tray is substantially unalloyed with iron and said molten zinc flowed from said other coating tray is completely alloyed with iron.

43. The method of claim 42 wherein said temperature is at least 500° C.

* * * * *